United States Patent [19]

Hassinger

[11] Patent Number: 5,010,667

[45] Date of Patent: Apr. 30, 1991

[54] IDENTIFICATION TAG FOR ROLLED DRAWINGS

[76] Inventor: Herman A. Hassinger, 282 Chester Ave., Moorestown, N.J. 08057

[21] Appl. No.: 372,571

[22] Filed: Jun. 28, 1989

[51] Int. Cl.[5] ..... G09F 3/00

[52] U.S. Cl. ..... 40/309

[58] Field of Search ..... 40/309, 310, 299, 625, 40/539, 421, 665, 539

[56] References Cited

U.S. PATENT DOCUMENTS

| | | | |
|---|---|---|---|
| 1,479,616 | 1/1924 | Lonergan | 40/309 |
| 1,564,752 | 12/1925 | Brown | 40/310 |
| 1,617,850 | 2/1927 | Kelly | 40/625 |
| 1,632,475 | 6/1927 | Hoefler | 40/309 |
| 1,738,378 | 12/1929 | Little | 40/309 |
| 3,992,794 | 11/1976 | Lazarus | 40/309 |
| 4,471,547 | 9/1984 | Koslow | 40/309 |

FOREIGN PATENT DOCUMENTS

| | | | |
|---|---|---|---|
| 528423 | 5/1954 | Belgium | 40/539 |

*Primary Examiner*—Kenneth J. Dorner
*Assistant Examiner*—J. Hakomaki
*Attorney, Agent, or Firm*—Norman E. Lehrer

[57] ABSTRACT

An identification tag for rolled drawings is made froma sheet of heavy stock paper. The tag is enlongated and is preferably from two to three inches wide and five to eight inches long. One end of the device is a holding portion while the other end is the tag portion. Between the two is a transition portion which is comprised of a score line in the paper which extends across the width of the device in an arc. When the holding portion is flexed so as to be inserted into the end of a rolled document, the tag portion can be folded downwardly where it remains substantially planar and perpendicular to the axis of the holding portion and covers the end of the rolled document for identifying the same.

5 Claims, 1 Drawing Sheet

IDENTIFICATION TAG FOR ROLLED DRAWINGS

BACKGROUND OF THE INVENTION

The present invention is directed toward an identification tag or label and more particularly toward such a label which is particularly adapted for labeling the ends of rolled drawings.

Most mechanical, engineering and architect's drawings are made on large sheets of paper which are clearly not suited for storage in ordinary letter or legal sized files. While these drawings and blueprints and the like can be folded to fit into standard filing cabinets, this is not typically done since the folds can distort the drawing and make it difficult for the user to take off accurate measurements. Accordingly, the preferred way for storing such drawings is to keep them flat or to roll the same.

There are special purpose filing cabinets for storing drawings in a flat condition. However, this special filing equipment is expensive and takes up a great deal of space. Accordingly, most drawings are rolled and typically are maintained in the rolled form through the use of rubber bands or the like. Thereafter, these rolls are either simply stacked on top of each other on a shelf with their ends exposed or are stored in racks which include holes therein into which the rolled drawings are inserted.

The primary problem with any of the commonly used storage systems for rolled drawings is that it is difficult to identify any of the drawings in the stack. What normally must be done is that the architect or contractor must remove each drawing and partially unroll the same to look at the title block in order to determine whether he has retrieved the correct drawing. Many users have written a short description on the outside of the drawings but this does not totally solve the problem since the drawings must still be removed from the stack in order to read the description written on the outside.

Devices have been proposed in the past for labeling the ends of rolled drawings so that they can be identified without removing the rolls from a rack or stack. U.S. Pat. No. 4,745,696, for example, shows a wire loop which is spring loaded and which can be inserted into the hollow open end of a rolled drawing. A visual marker in the form of a flat disk with a boss on the rear surface thereof is press fit onto the wire loop. A molded plastic device having an elongated cylindrical portion and a flat label portion is shown in U.S. Pat. No. 4,471,547. This device is also intended to be inserted within the open end of a rolled drawing. A device known as a "Clipper Tag" sold by Saga Division of DADE Inc. of Minneapolis, Minn., has a pair of elongated metal clips where one of the clips fits into the interior of the rolled drawing and the second clip extends exterior thereof so as to prevent the rolled drawing from unrolling. A tag is mounted on the clips and perpendicular thereto at the end of the roll.

While each of the foregoing devices is capable of performing a function of identifying rolled documents from the ends thereof, these devices are relatively expensive because of their complex construction. More simplified devices are, therefore, desirable.

Prior U.S. Pat. Nos. 1,480,307; 2,001,054 and 3,992,794 also show devices which can be used to identify rolled products from the ends thereof. However, these devices are primarily useful with respect to larger rolled products such as rolled carpeting or cloth bolt type products wherein the center portion of the rolled material is flat rather than round. The devices shown in these patents are not useful for rolled drawings.

SUMMARY OF THE INVENTION

The purpose of the present invention is to overcome all of the deficiencies of the prior art discussed above and to provide a device which is extremely inexpensive to produce and simple to use. According to the invention, an identification tag for rolled drawings is made from a sheet of heavy stock paper. The tag is elongated and is preferably from two to three inches wide and five to eight inches long. One end of the device is a holding portion while the other end is the tag portion. Between the two is a transition portion which is comprised of a score line in the paper which extends across the width of the device in an arc. When the holding portion is flexed so as to be inserted into the end of a rolled document, the tag portion can be folded downwardly where it remains substantially planar and perpendicular to the axis of the holding portion and covers the end of the rolled document for identifying the same.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
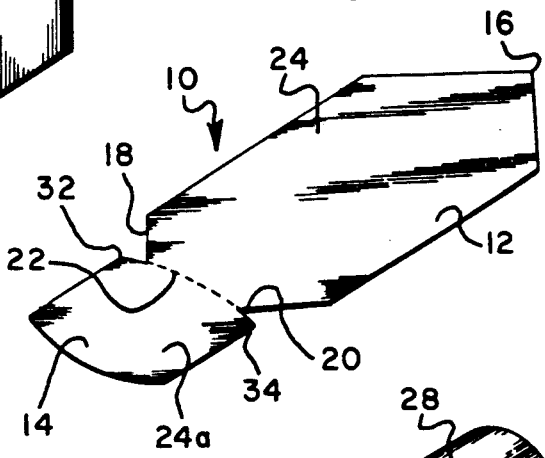
FIG. 2 is a perspective view of an identification tag of the present invention showing the same in flat form prior to being used.
Figure 3:
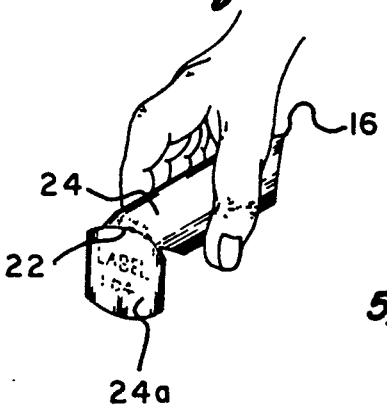
FIG. 3 is a perspective view of a device such as shown in FIG. 2 but showing the sam ready to be inserted into the end of a rolled drawing.

Referring now to the drawings in detail wherein like reference numerals have been used throughout the various figures to designate like elements, there is shown in FIG. 2 an identification tag constructed in accordance with the principles of the present invention and designated generally as 10. Identification tag 10 is an elongated strip of substantially planar sheet material such as heavy paper or paperboard or the like. While various materials could be utilized, the material must be of sufficient thickness and composition so as to be rigid enough to be substantially self-sustaining but flexible enough so that it can be easily flexed by a person's fingers as shown in FIG. 3. Furthermore, as will be explained more fully below, at least a portion of one surface thereof must be capable of being written thereon with a pen, pencil or marker or the like.

Identification tag 10 is divided into a forward holding portion 12 at the front end thereof and a tag portion 14 at the rear end. Preferably, the holding portion 12 and tag portion 14 are integral with each other. That is, the holding portion 12 and tag portion 14 are preferably made from a single piece of stock material.

Each of the holding portion 12 and tag portion 14 is substantially rectangular in shape. Preferably, however, the forward end of the holding portion 12 tapers to a point as shown at 16. Furthermore, the rearward end of the holding portion 12 tapers inwardly as shown at 18 to form a transition portion 20 which separates the holding portion 12 from the tag portion 14. Located in the transition portion and extending across the width of the same is a score line 22. Score line 22 is formed by creasing, pressing or otherwise weakening the transition portion. As shown most clearly in FIG. 2, the score line 22 is arcuately shaped with the center portion of the line 22 being in the direction of the holding portion 12 and the ends of the line 22 being closer to the tag portion 14.

In one preferred embodiment of the invention the overall length of the identification tag is approximately five and one-half inches with the length of the holding portion 12 being approximately four inches and the length of the tag portion being approximately one and one-half inches. In this embodiment, the width of the holding portion is two inches, the width of the tag portion is approximately one and one-half inches and the overall width of the identification tag at the transition portion is one and one-eighth inches. In a second preferred embodiment, the overall length of the identification tag is eight and one-quarter inches with the holding portion being approximately six inches and the length of the tag portion being two and one-quarter inches. In this second embodiment, the width of the holding portion is approximately three inches while the width of the tag portion is approximately two and one-quarter inches and the width of the transition portion being one and three-quarter inches. These various dimensions are, of course, by way of example only as various other sizes are also possible.

Figure 4:
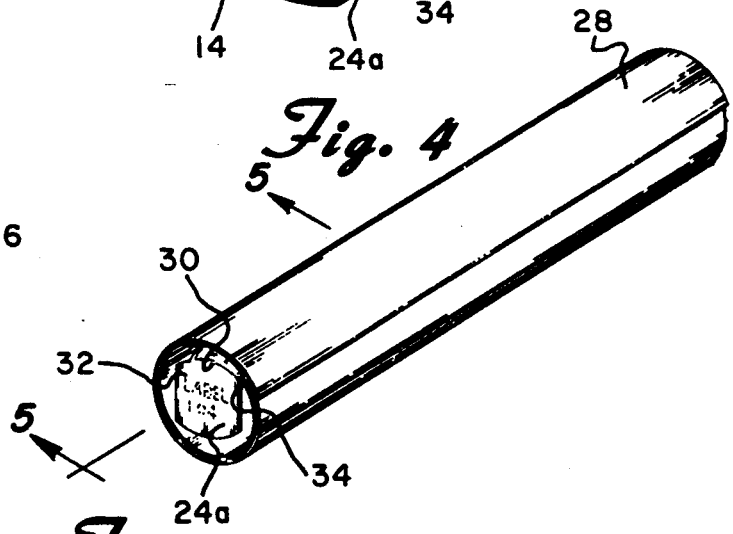
FIG. 4 is a view similar to FIGS. 1 and 3 showing a single drawing with an identification tag mounted at the end thereof.
Figure 5:
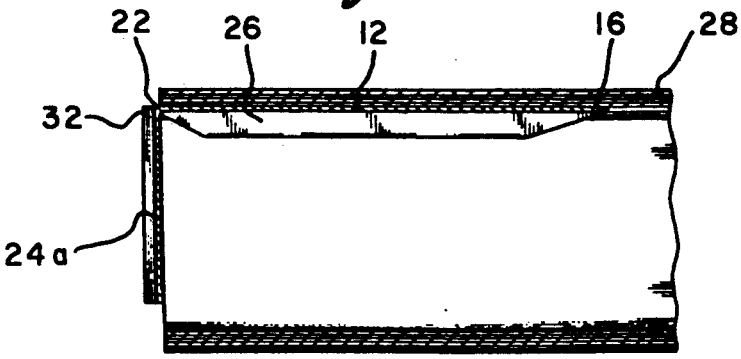
FIG. 5 is a cross-sectional view taken through the line 5—5 of FIG. 4.

The identification tag 10 has an upper surface 24 and a lower surface 26 which is not shown in FIG. 2 but which is partially visible in FIG. 5. In use, the upper surface 24a of the tag portion 14 is visible from the end of the rolled document 28 such as shown in FIG. 4 and is therefore utilized to carry identifying indicia or the like thereon. For this reason, the upper surface 24a of the tag portion 14 must be capable of being written on by a writing utensil such as a pen, pencil or marker or the like. It is, of course, also possible to have the upper surface 24a such as to be incapable of being written upon whereby a gummed or adhesive label or the like can be applied to the surface 24a and whereby the label can then be written upon. However, it is preferable to have the identification tag 10 itself be made of a material such as paper or the like so that the upper surface 24a of the tag portion 14 can be written on in order to identify a document.

The identification tag 10 of the present invention is utilized in the following manner. When it is desired to identify or label a rolled document such as drawing 28 shown in FIGS. 4 and 5, a person grabs the side edges of the holding portion 12 between his thumb and fingers as shown in FIG. 3 and squeezes slightly inwardly thereby causing the identification tag to flex so that the center, between the side edges, arcs upwardly and the side edges are facing downwardly. The identification tag 10 is flexed so as to take on a partial cylindrical shape of approximately the same curvature as the rolled drawing to which it is to be applied. Thereafter, the tag portion 14 of the identification tag 10 is bent downwardly so as to be in a position which is approximately perpendicular to the axis of the holding portion 12. The identification tag will, of course, fold at the score line 12 and because of the arcuate shape of the score line, the tag portion 14 will tend to remain in its substantially perpendicular position as long as the holding portion is flexed. The tag portion 14 will also be substantially planar in shape but at least the upper edge thereof will be slightly curved inwardly as shown in FIG. 4. That is, the uppermost and centermost point 30 of the transition portion 20 and score line 22 will be slightly rearwardly of the upper side edge points 32 and 34. With the holding portion 12 flexed as shown in FIG. 3 and the tag portion 14 being held downwardly, the pointed end 16 of the holding portion is inserted into the end of a rolled document 28 preferably by inserting the same between several layers of the spiralled paper which forms the rolled document 28. In this way, the partial cylindrical shape of the holding portion 12 will be maintained by the rolled document 28 and, as a result, the tag portion 14 will maintain itself in its substantially perpendicular position.

Figure 1:
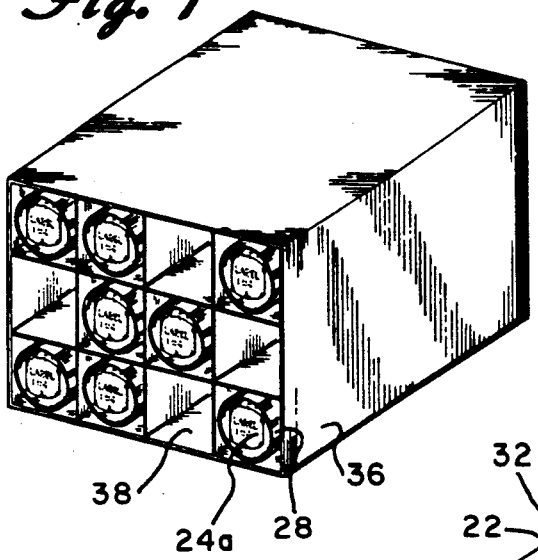
FIG. 1 is a perspective view of a rack showing a plurality of rolled drawings being contained therein with each one identified by an identification tag constructed in accordance with the principles of the present invention.

Either prior to inserting the identification tag into the rolled drawing or after the same is inserted, the drawing 28 can be identified by writing relevant information concerning the same on the surface 24a of the tag portion 14. In this way, the rolled document 28 can be identified by merely looking at the end thereof without having to unroll the document or look at a label or other identifying material which may be written on the outside side surface thereof. This is particularly useful when a plurality of drawings are stacked on top of each other or are maintained in a cabinet such as shown at 36 in FIG. 1. Cabinet 36 includes a plurality of elongated openings or slots 38 which are each intended to hold a different rolled document therein. As can be seen in FIG. 1, when such a cabinet is used, only the ends of the rolled documents are visible and the information written on the outer surface 24a of the identification tag 10 constructed in accordance with the principles of the present invention can be readily and easily seen from the outside of the cabinet.

The present invention may be embodied in other specific forms without departing from the spirit or essential attributes thereof and accordingly reference should be made to the appended claims rather than to the foregoing specification as indicating the scope of the invention.

I claim:

1. An identification tag for identifying rolled documents such as architectural or engineering drawings or the like that are normally rolled into cylindrical form with the sheets thereof forming a spiral and wherein said rolled documents are normally stacked upon each other or stored in a rack with only their ends exposed, said tag comprising:

an elongated strip of substantially planar sheet material, said material being of a thickness and composition so as to be rigid enough to substantially sustain its shape but flexible enough so that it can be easily flexed by a person's hand;

said strip being divided into a holding portion at one end thereof and a tag portion at the other, said holding portion and said tag portion being integral with each other;

a transition portion lying between said holding and tag portions, said transition portion including a score line across the width of said strip, said score line being arcuately shaped with the center portion of said line being in the direction of said holding portion;

the width of said transition portion being less than the width of said tag portion and less than the width of the main section of said holding portion, the width of said transition portion being narrowest at said score line and tapering outwardly to said tag portion at one end thereof and to said holding portion at the other end;

whereby when the side edges of said holding portion are flexed downwardly to curve said holding portion into the shape of a rolled document, the tag portion can be bent downwardly where it substantially retains its planar shape and also remains in a position which is substantially perpendicular to the axis of said holding portion, the upper edge of said tag portion adjacent said transition portion, however, being concavely curved.

2. The invention as claimed in claim 1 wherein said identification tag is comprised of paper.

3. The invention as claimed in claim 1 wherein the upper surface of said tag portion is capable of being written on.

4. The invention as claimed in claim 1 wherein the width of said holding portion is greater than the width o said tag portion.

5. The invention as claimed in claim 1 wherein the free end of said holding portion tapers to a point.

* * * * *